US006102568A

United States Patent [19]

Davis

[11] Patent Number: 6,102,568

[45] Date of Patent: Aug. 15, 2000

[54] COLLAPSIBLE, RECYCLABLE RECEPTACLE

[76] Inventor: Heidi Comfort Davis, 3608 Lowell St., Deephaven, Minn. 55391

[21] Appl. No.: 08/748,179

[22] Filed: Nov. 12, 1996

[51] Int. Cl.[7] ..... B65D 30/16; B65D 33/02; B65D 33/30

[52] U.S. Cl. ..... 383/43; 229/103.11; 229/115; 229/117.32; 229/117.34; 229/403; 229/404; 229/405; 383/119

[58] Field of Search ..... 383/119, 43, 907; 229/400, 405, 403, 115, 23 R, 117.32, 117.33, 117.34, 404, 103.11; 220/404

[56] References Cited

U.S. PATENT DOCUMENTS

| | | | |
|---|---|---|---|
| 579,058 | 3/1897 | Glover | 383/119 |
| 1,171,431 | 2/1916 | Gorton | 229/400 |
| 1,217,599 | 2/1917 | Hill | 220/404 |
| 2,180,841 | 11/1939 | Vogt . | |
| 2,307,902 | 1/1943 | Vogt et al. | 383/119 |
| 2,493,633 | 1/1950 | Mart | 229/403 |
| 2,661,890 | 12/1953 | Stastny et al. | 229/23 R |
| 2,706,370 | 4/1955 | Snyder | 220/404 |
| 3,144,129 | 8/1964 | Weisberg . | |
| 3,339,721 | 9/1967 | Goldstein | 383/119 |
| 3,482,758 | 12/1969 | La Pierre et al. | 383/119 |
| 3,542,566 | 11/1970 | Wakefield . | |
| 3,547,660 | 12/1970 | Weisberg . | |
| 3,640,381 | 2/1972 | Kanada et al. . | |
| 5,096,306 | 3/1992 | Stenstrom et al. . | |
| 5,105,969 | 4/1992 | Lamas . | |
| 5,337,915 | 8/1994 | Hall, Jr. | 220/404 |
| 5,501,358 | 3/1996 | Hobday . | |

*Primary Examiner*—Stephen P. Garbe
*Attorney, Agent, or Firm*—Briggs and Morgan

[57] ABSTRACT

The present invention provide a collapsible, recyclable, fluid receptacle readily assembled from a either single blank or two substantially identical blanks to form an outer shell and a flexible inner liner attached to said shell having sufficient strength and properties to retain a liquid therein without leaking.

9 Claims, 8 Drawing Sheets

COLLAPSIBLE, RECYCLABLE RECEPTACLE

FIELD OF THE INVENTION

The present invention relates generally to containers or receptacles useful in containing diverse fluids, such as a drinkable beverage, a motor lubricant, or other fluid, and particularly to a receptacle that can be manufactured from a blank made of diverse materials, that can assume a collapsed form either before use, after use, or both, and that is recyclable.

BACKGROUND OF THE PRESENT INVENTION

Fluid receptacles of various types are, of course, known in the art. Generally, such receptacles are formed of a single wall of a structural material, such as glass, plastic, paper, cardboard, metal, or wood, such that the receptacle at all times retains its rigid shape. Certain reusable, collapsible-type beverage containers are known, such as telescoping camping-type cups. These are typically formed from metal and include a plurality of meshed truncated conical sections that telescope to form substantially cylindrically configured cup. The known rigidly configured drinking receptacles can require a substantial storage space, thereby increasing the cost to businesses of storing them on premises as well as transporting them to their end use location.

Many of the paper fluid containers presently marketed are capable of being recycled, yet none of them are capable of being taken readily and directly from a collapsed configuration to a fluid-holding configuration. In addition, many such beverage containers known to this inventor are unstable and are not readily usable in a moving vehicle. Many vehicle operators, for example, place a beverage container on the dash of their vehicle while driving. During vehicle maneuvers, such as turns and lane changes, the beverage container may tip over and spill its contents. Sometimes the containers will slide sideways on the dash during such maneuvers. This often results in drivers lunging sideways in an attempt to prevent the sliding container from spilling—a dangerous action when operating a moving vehicle and an action that this inventor believes has more than once caused accidents and serious injuries or deaths.

In addition to the foregoing disadvantages on known mass produced paper or plastic drinking cups, those cups also require a lid when used in a motor vehicle. This is another expense item for the business and the consumer. A problem with such lids is that they do not have, in this inventor's experience, any self-closing or self-sealing properties. Generally, once the opening in made in the lid through which the beverage pours, the opening remains open and cannot be closed or sealed to reduce or eliminate spillage.

Another problem with presently available paper drinking containers is that they provide little or no insulation value, thus allowing the fluid to reach room temperature rather rapidly. In addition, when a hot liquid such as coffee is placed in the cup, the heat is readily transmitted through the walls of the cup, be it manufactured from glass, paper, plastic or any other known material, into the consumer's hand. For example, in many commercial coffee boutiques, the coffee is dispensed at a temperature near the boiling point of water. Consequently, the cup will often become literally too hot to handle. To solve this problem, many such coffee shops are now "double cupping;" that is, providing the coffee in two nested cups so as to create somewhat of an insulating air barrier between the walls of the nested cups.

This obviously increases the cost of providing a cup of coffee to the consumer, which is either passed on to the consumer in the form of higher costs for cups taken from the premises or is absorbed by the business.

Finally, the general design of available mass produced drinking cups enhances instability and spillage. Thus, these cups are generally formed to assume a conically tapering structure with a circular top and a circular bottom where the top has a greater radius than the bottom. Thus, such a cup is inherently unstable in that the center of mass tends to be very high in relation to the overall height of the fluid held within the cup. In addition, the conically outwardly tapering walls promotes the sloshing of the beverage or other fluid out of the cup.

It would be desirable to have a paper or plastic fluid receptacle capable of use for holding a fluid such as a motor lubricant or drinking beverage, that was available for storage in a collapsed configuration to minimize storage space and that could be readily reconfigured to a fluid-holding configuration without the aid of tools, glues, or the like. It would furthermore be desirable to have a fluid receptacle that would provide additional stability over known receptacles and still readily assume the collapsed configuration prior to and after use as a fluid receptacle. It would be still further desirable to have a fluid receptacle that would provide insulating value to the consumer, particularly when the receptacle is holding a hot fluid such as coffee. Such a receptacle would enable the consumer to maintain the fluid at the desired temperature for a greater length of time than with similar available containers and that would function to reduce the likelihood of the consumer being burned by a hot fluid.

SUMMARY OF THE INVENTION

It is an object of the present invention to provide new and improved apparatus that is not subject to the foregoing disadvantages.

It is another object of the present invention to provide a collapsible fluid receptacle.

It is still another object of the present invention to provide a collapsible fluid receptacle that provides insulation value over and above that provided by currently available paper or synthetic material receptacles.

It is yet another object of the present invention to provide a collapsible fluid receptacle that is more stable than currently available, mass produced drinking cups.

It is still yet another object of the present invention to provide a collapsible fluid receptacle that utilizes less storage space than currently available, mass produced drinking cups in either the collapsed configuration, the filled configuration, or both.

The foregoing objects of the present invention are provided by a fluid receptacle preferably readily assembled from a either single blank or two substantially identical blanks. A fluid receptacle according to the present invention will include an outer shell formed from the blank(s) that can adopt a fairly rigid configuration and a flexible inner liner having sufficient strength and properties to retain a liquid therein without leaking. The liner will be attached to an end of the shell, preferably the upper edge and will be suspended therefrom in the interior of the shell. Thus, when a fluid is placed therein the liner will be substantially suspended from the upper edge of the shell and will be otherwise disengaged from the receptacle, particularly the sidewalls thereof, thus providing an insulating barrier of air between the liner and the shell. When assembled, the receptacle according to the present invention will present a triangular configuration when viewed from the side and will have a substantially rectangular base. The receptacle will have a pair of side walls that are inclined from the base upwardly and that join at the top to form a self-closing opening through which the enclosed fluid may be poured. Thus, a receptacle according to the present invention will have an upwardly, inwardly tapering configuration in at least one dimension that will provide a lower center of gravity relative to the height of the fluid than can generally be found in available mass produced cups.

In a preferred embodiment, the present invention has a height defined by the end walls and the inner liner has a vertical height less than the height of the end walls such that the liner will not engage a surface upon which the receptacle rests.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Referring now to the various Figures, a description of the present invention will be provided with its advantages over the prior art being emphasized. It will be seen that the present invention provides unexpected benefits not found in the prior art nor anticipated or obvious in light thereof.

Figure 1:
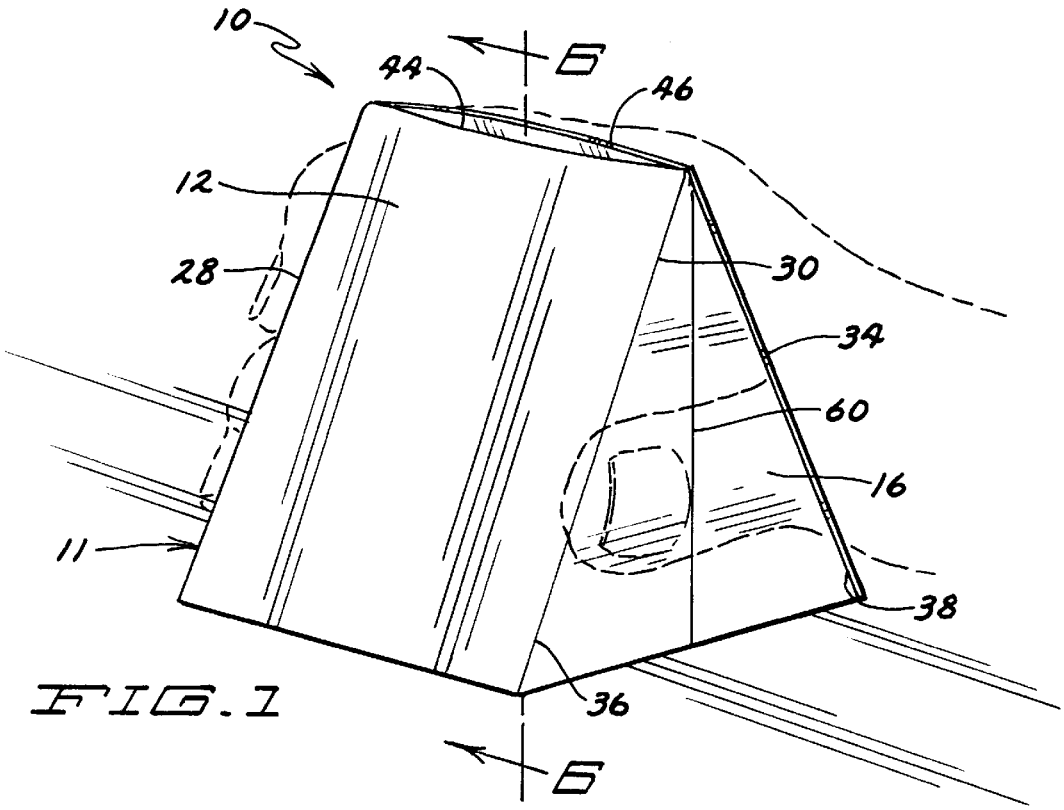
FIG. 1 illustrates an embodiment of the present invention in a perspective view.
Figure 6:
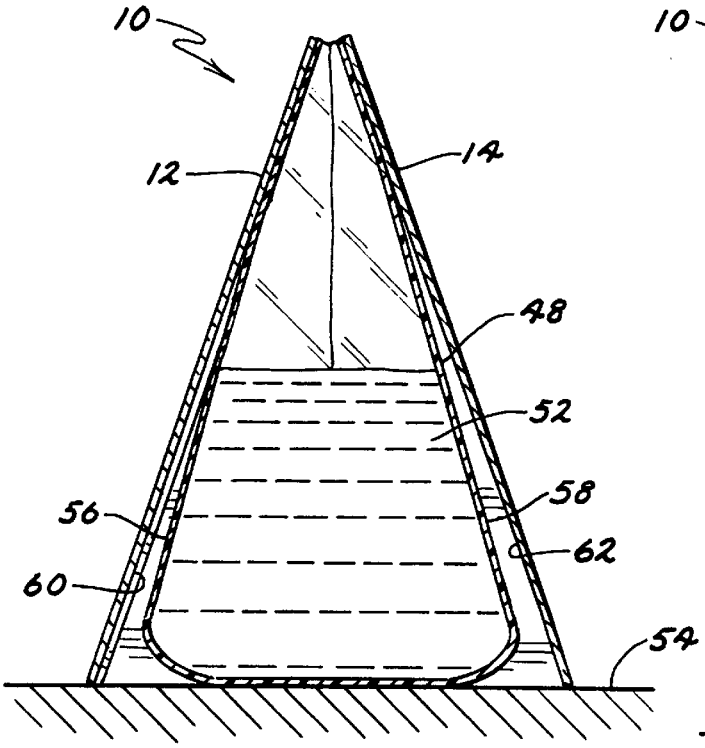
FIG. 6 is a cross sectional view of the invention shown in FIG. 1 taken along viewing plane 6—6 of FIG. 1.
Figure 5:
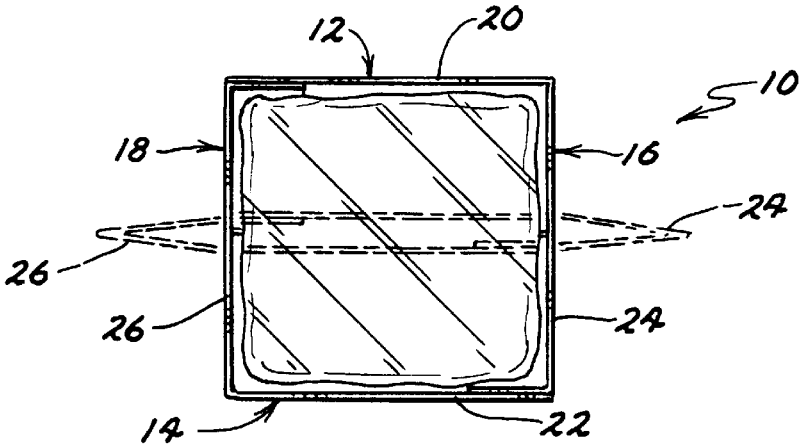
FIG. 5 is a bottom plan view of the invention shown in FIG. 1 in the expanded configuration and in the collapsed configuration in phantom outline.

FIG. 1 shows an embodiment of the present invention 10—a collapsible fluid receptacle—in a perspective view. As shown in that embodiment, the present invention 10 has a configuration that is substantially rectangular from the side (FIG. 2) and bottom (FIG. 5) and is substantially triangularly configured when viewed from an end thereof (FIGS. 6, 6A). Thus, the receptacle 10 includes an outer shell 11 having a pair of substantially rectangularly shaped side walls 12 and 14. Receptacle 10 also includes a pair of opposed end walls 16 and 18 having a substantially triangular configuration. Walls 12, 14, 16, and 18 each include a base edge 20, 22, 24, and 26, respectively. Receptacle 10 will rest on base edges 20, 22, 24, and 26.

Each wall also includes a pair of side edges. Thus side wall 12 has a pair of side edges 28 and 30; side wall 14 has a pair of side edges 32 and 34; end wall 16 has a pair of side edges 36 and 38; and end wall 18 has a pair of side edges 40 and 42. From the various views of the present invention shown in the Figures it will be understood that side edges 28 and 40 of side wall 12 and end wall 18, respectively, are substantially collinear; side edges 30 and 36 of side wall 12 and end wall 16, respectively, are substantially collinear; side edges 32 and 42 of side wall 14 and end wall 18, respectively, are substantially collinear; and that side edges 34 and 38 of side wall 14 and end wall 16, respectively, are substantially collinear. Side walls 12 and 14 each include a top edge 44 and 46 respectively.

Figure 3:
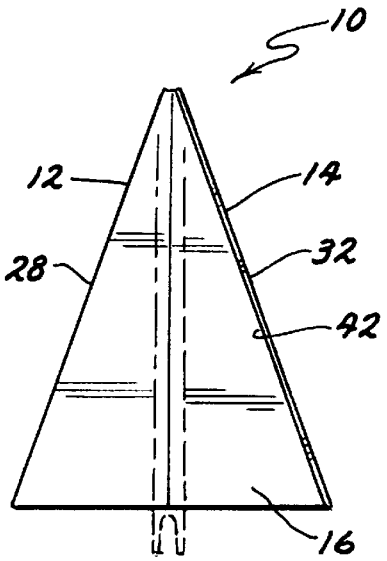
FIG. 3 shows an end elevation view of the invention shown in FIG. 1 in the expanded configuration and in the collapsed configuration in phantom outline.

Referring now to FIGS. 3, 5, 6, 6A and 7, in particular, it will be observed that the receptacle 10 includes an inner flexible liner 48 attached to and substantially suspended from the top edges 44 and 46. Liner 48 is provided to hold the fluid within the receptacle 10. FIG. 3 shows the unfolded or uncollapsed receptacle 10 with the collapsed position shown substantially in phantom. FIG. 6 shows a receptacle 10 in accord with the present invention where a fluid 52 has been added to the receptacle. As seen in that Figure, when the receptacle is set on a surface 54, the bottom end 50 of the liner 48 will assume the shape of the surface upon which it rests, in this instance a flat surface.

FIG. 6 should be compared with FIG. 6A. In this FIG. 6A the liner 48 has a shorter vertical length than that of the liner shown in FIG. 6. In both FIGS. 6 and 6A the weight of the fluid in the liner acts to pull the flexible liner side walls inwardly away from the interior surfaces 60 and 62 of the side walls 12 and 14, respectively. In FIG. 6A, however, the bottom end 50 of the liner will lie a short distance above the surface 54, thus providing an insulating air layer 55 between the bottom end 50 and the surface 54. FIG. 6A is a preferred configuration since when used as a beverage cup, receptacle 10 will insulate the fluid therein substantially on all sides with an air layer, thus aiding in keeping the fluid hot or cold as desired. In both Figures, the fluid containing liner will have little or no contact with the outer shell of the receptacle 10, thus providing a substantial insulation value. That is, the configuration shown will create an insulating layer of air between the side walls 12 and 14 and the liner walls 56 and 58. In turn, this makes the receptacle more comfortable to hold and reduces the likelihood that the receptacle will be too hot to hold due to heat transference from the cup through the sidewalls while the receptacle is being held. In both embodiments, however, the outwardly sloping side walls and the inner liner will tend to separate from each other at least in part because the liner is suspended from the closely adjacent top edges 44 and 46 and will thus tend to hang straight down from those edges, from which the side walls slope away.

It will be understood that as the vertical height of the liner 48 is increased that eventually the liner 48 will engage the sides of the shell 11 substantially entirely when the receptacle is placed on a surface. Raising the receptacle upwards, however, will allow the "pull" exerted on the liner due to gravity to "move" the liner sides inwardly away from the outer shell 11, thus providing an insulating value to the embodiment shown in FIG. 6A when the receptacle is held. This inventor has determined that the foregoing structural configuration can have significant insulation value. For example, in one simple experiment ice was placed in a standard cup and a receptacle according to the present invention. The ice in the standard cup melted seventeen minutes before the ice in the present invention, clearly indicating the insulating value provided by the present invention.

The use of the present invention as a drinking cup is shown in FIG. 1 in particular. There, a hand is shown in phantom outline grasping the receptacle 10. By gently squeezing on the end walls 16 and 18, such as by a user exerting an inwardly directed force with the fingers and thumb shown in phantom in FIG. 1, the top edges 44 and 46 will be forced apart, assuming a somewhat oval configuration. That is, because the top edges 44 and 46 are attached to each other at the ends, an inwardly directed pressure on the ends will force the center portions of the top edges 44 and 46 to bow outwardly, creating the substantially oval shaped opening. The receptacle can then be placed against the user's lips and tilted to allow the beverage therein to flow out of the receptacle. The shape of this oval opening directs the fluid into the consumer's mouth, another advantage of the present invention over commercially available standard cups. By relaxing the grip on the receptacle 10, the user will allow the natural resiliency of the material forming the outer shell, that is side wall and end walls 12–18, to return the receptacle to its previously undeformed shape. Thus, relaxing the grip will cause the oval shaped opening previously formed to return to its original shape.

In addition, the present invention's unique structure and configuration aids in the return of the receptacle to its original configuration. Thus, the weight of the fluid within the liner 48 will pull downwardly on the top edges 44 and 46. This downward pulling action of the weight of the fluid in the receptacle 10 will in turn pull the top edges 44 and 46 toward each other, thus tending to close up the opening through which the beverage was just drunk.

Figure 6B:
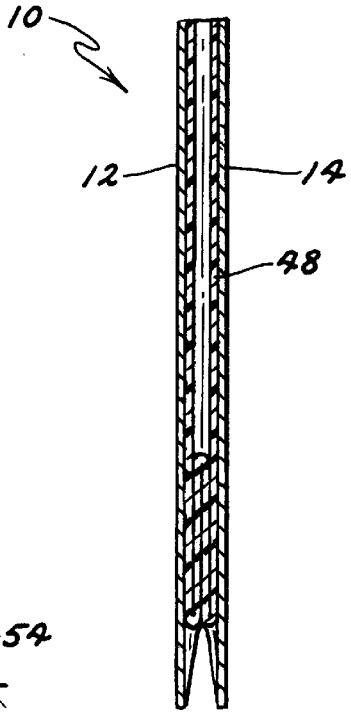
FIG. 6B illustrates the invention shown in FIG. 1 in a collapsed configuration prior to the addition of a fluid thereto.
Figure 4:
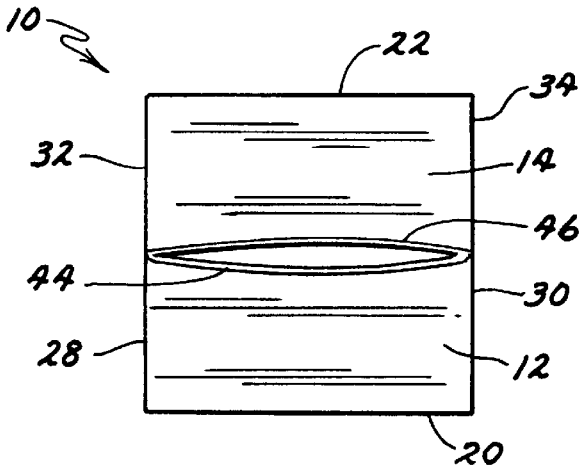
FIG. 4 depicts the invention shown in FIG. 1 in a top plan view with the access opening depicted slightly open.
Figure 2:
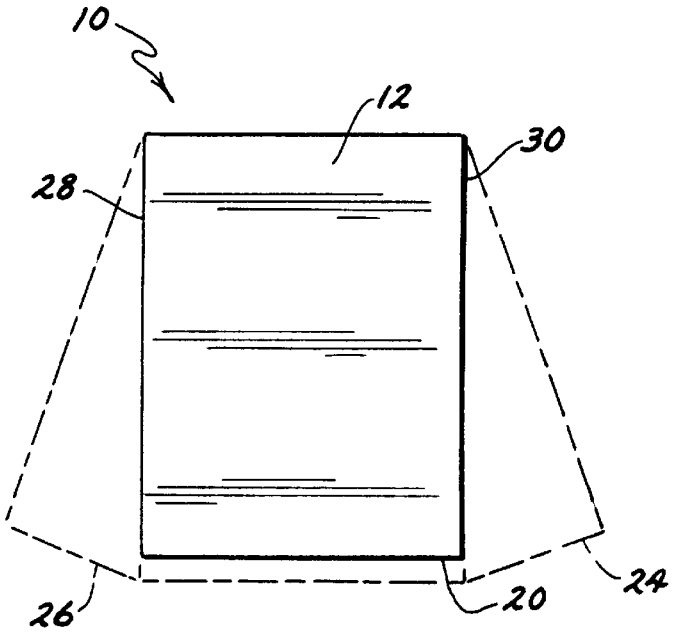
FIG. 2 shows a side elevation view of the invention shown in FIG. 1 in the expanded configuration and in the collapsed configuration in phantom outline.
Figure 6A:
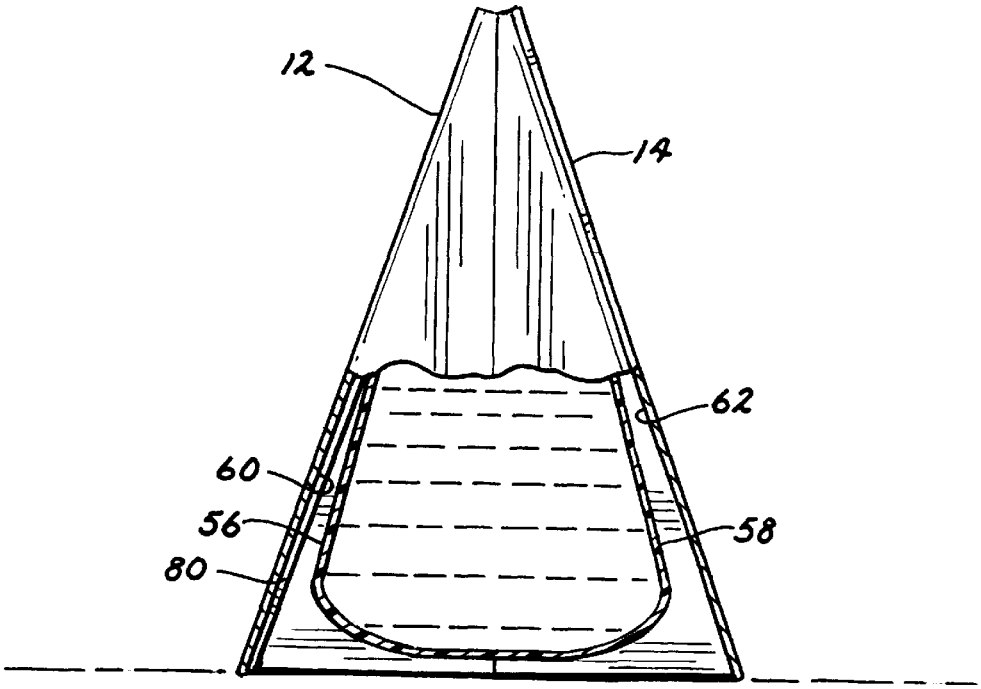
FIG. 6A depicts the invention of FIG. 1 raised above a supporting base or as it would appear if held in a user's hand (not shown).

Referring now to FIGS. 2, 6B, 7, 8, and 11, the construction and collapsibility of the receptacle 10 will be further explained. As seen in FIG. 2, the receptacle 10 is shown in its collapsed phase in phantom outline. It will be appreciated that the end walls 16 and 18 are appropriately folded along a fold line substantially in the center thereof to allow the end walls to bend therealong. The fold lines each define the height of the end wall and in turn the height of the receptacle. It will be appreciated that the liner 48 has a vertical height that is preferably less than the height of the fold line, thus enabling the bottom 50 of the liner 48 to be suspended above the surface as indicated in FIG. 6 when the receptacle contains fluid. In FIG. 2, the receptacle is shown in a collapsed condition in phantom with the end walls 16 and 18 collapsed such that they extend outwardly from interior of the receptacle 10. The end walls 16 and 18 could also be folded inwardly if desired, resulting in a configuration that when viewed from the side would look substantially like the bold lines of FIG. 2—that is, essentially a flat, rectangular structure. FIG. 6B shows the receptacle 10 in a collapsed condition and illustrates the small amount of space that the collapsed receptacle 10 can assume both before and after use. In the collapsed condition shown in FIG. 6B the liner bottom 50 is preferably tucked upwards into the protective interior of the collapsed receptacle so as to prevent it from being accidentally cut or punctured before use.

Figure 7:
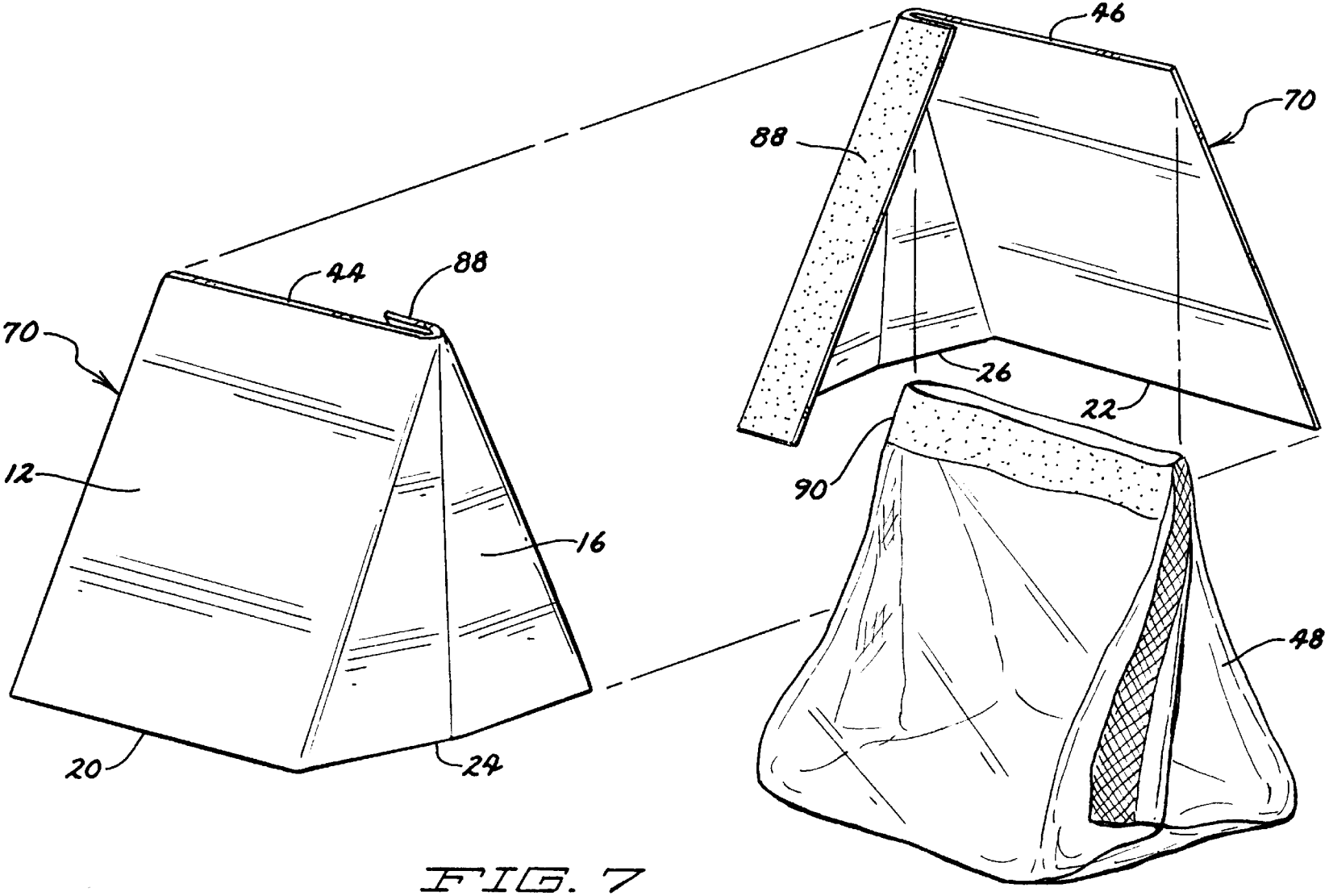
FIG. 7 is an exploded view of an embodiment of the present invention including a shell formed from a pair of substantial mirror image portions.
Figure 8:
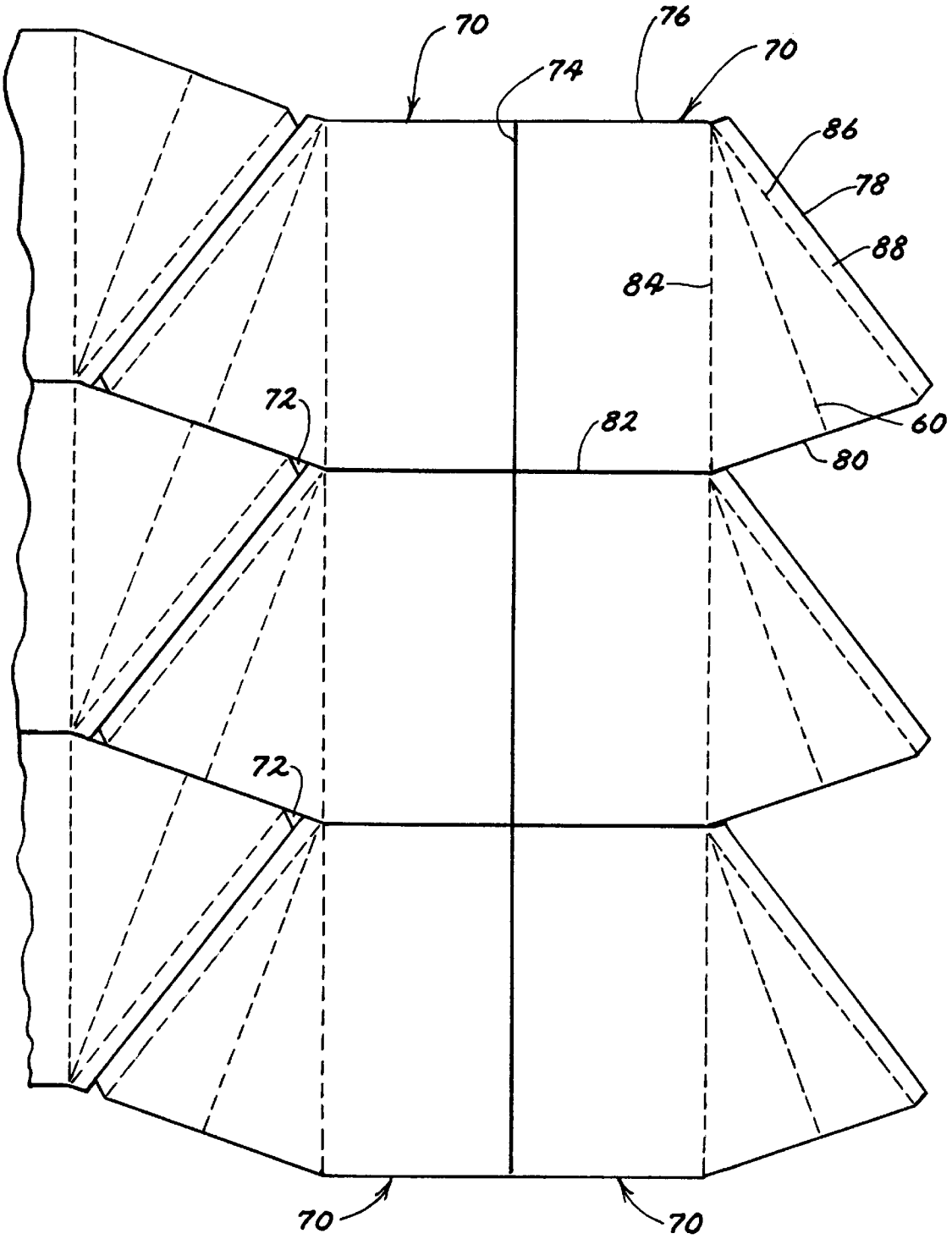
FIG. 8 shows how a blank could be scored to form the substantially mirror image portions illustrated in FIG. 7.
Figure 9:
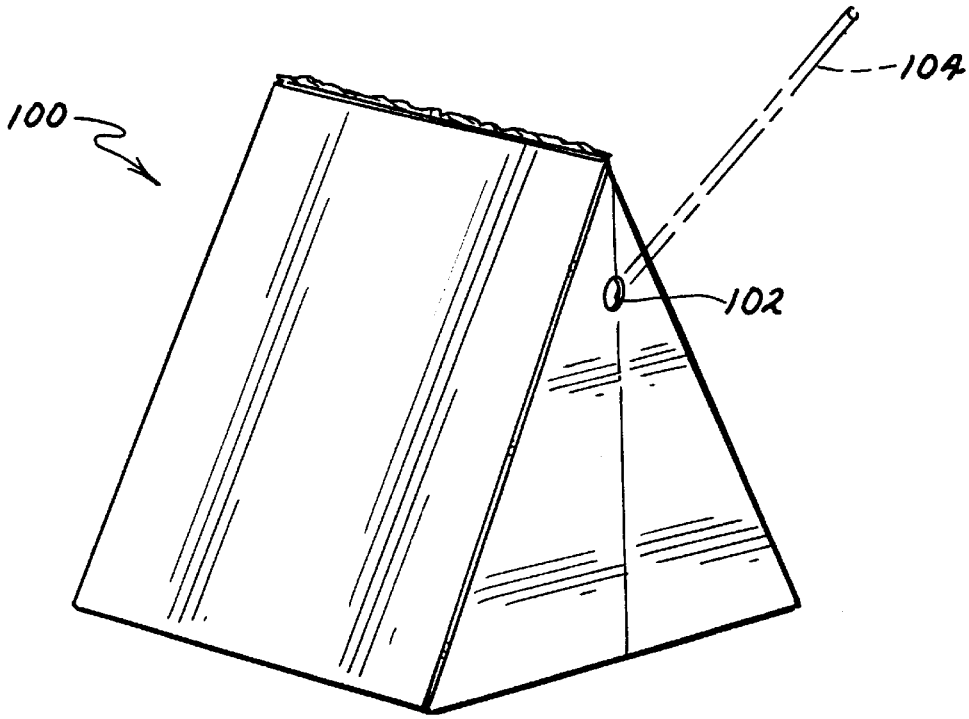
FIG. 9 illustrates an embodiment of the present invention wherein the container is sealed and the side of the shell includes an access port for a straw.

Referring now to FIG. 7, a receptacle 10 in accord with the present invention is shown in an exploded configuration. In this embodiment of the present invention, the receptacle 10 is formed from two substantially identical blanks 70 that have been appropriately folded along fold lines in the blanks. FIG. 8 illustrates how a piece of appropriate material—cardboard, plastic, or the like—can be cut and folded to form the blanks 70 with little waste. The use of two blanks as shown here can reduce the amount of waste material generated in the construction of the receptacle 10. As shown in the Figure, when two substantially identical blanks 70 are used to form the outer shell of the receptacle 10, only a small piece of material 72 is wasted between the blanks. Each blank 70 is thus cut along score lines 74–82 to form the blank 70 shown in FIG. 7. In addition, each blank 70 includes a plurality of fold lines 60, 84, and 86 that allow the end wall, either 16 or 18 to fold in the previously described manner.

With two blanks 70, then, that are folded along the fold lines as shown in FIG. 7, the blanks can be attached in any known manner to each other such as by the use of an adhesive along the tab 88 to form the outer shell of the receptacle 10. As seen in the Figure, tab 88 will be attached to the side wall of the opposing side. The inner liner 48 can be attached in any known manner, such as by an adhesive disposed along the upper edge 90, so as to hang downwardly inside the outer shell of the receptacle.

Figure 11:
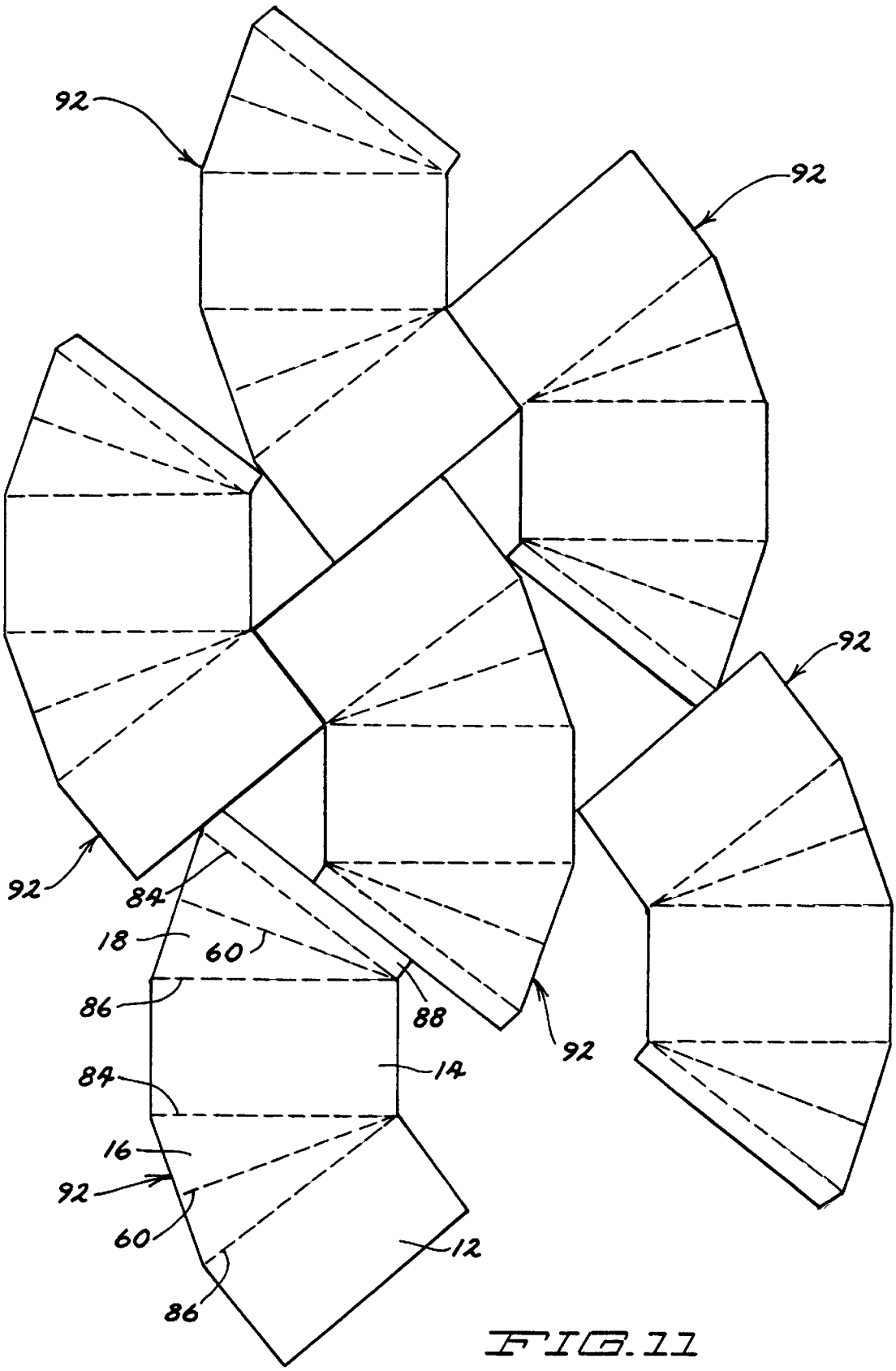
FIG. 11 depicts a blank scored for cutting out single pieces that can be formed into a collapsible fluid receptacle in accord with the present invention.

Alternatively, the collapsible receptacle 10 can be formed from a single blank 92 of material forming the outer shell 11. The blanks for doing so are shown in FIG. 11. As seen in FIG. 11, using a single piece of material results in a large amount of waste, though. Each blank will include side walls and end walls 12–18 and will be folded along the fold lines 60, 84 and 86 as previously described. In addition, each blank 90 will have a tab 88 extending outwardly from an end wall, denominated here with numeral 18, which is folded and attached to the other free end, here denominated side wall 12, of the blank 90. A liner 48 will be attached therein in the manner previously described.

Referring now to FIGS. 9, 10, 12 and 13, various other embodiments can be readily described as well as the many advantages the present collapsible container has over known prior art fluid containers. Thus, referring to FIG. 9, a receptacle 100 in accord with the present invention may include an access port 102 through which a drinking straw 104, shown in phantom, may be inserted. When such an embodiment is used, the receptacle 100 will be previously filled, such as by a bottling company. The inner liner 48 may, in such circumstances be attached to at least the end wall where the access port 102 is and perforated, with the perforation being covered in a known manner such as by the foil found in today's juice boxes. The foil may then be punctured by a sharp object, such as the end of the straw, and the fluid may be drunk therefrom.

Figure 10:
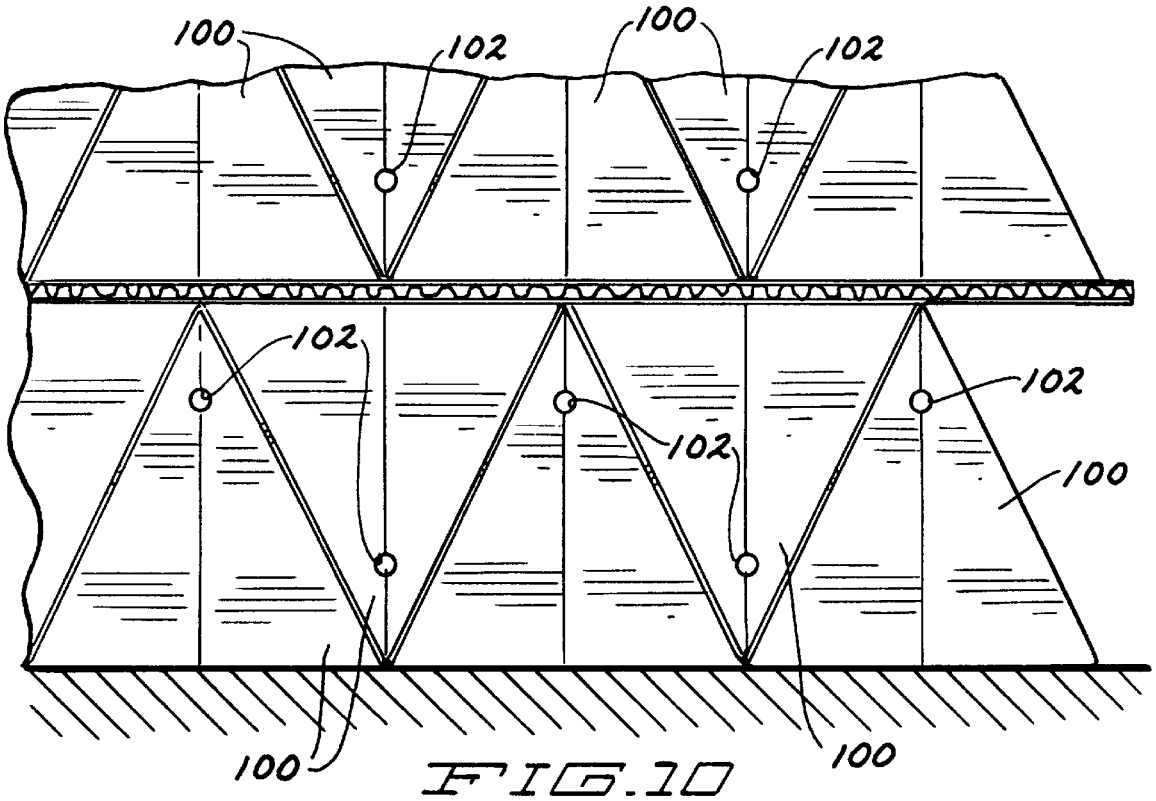
FIG. 10 shows a possible stacking method for the embodiment of FIG. 9 wherein storage space is reduced due to the configuration of the embodiment.

Referring to FIG. 10, now, it will be seen how a plurality of such pre-filled receptacles 100 can be stacked in a space efficient manner. Thus, there is illustrated in the Figure a portion of two layers of such receptacles 100 separated by a divider 104. Each layer includes a row of receptacles 100 stacked such that they have their apexes facing upward and a row of receptacles 100 stacked intermittent the first row with their apexes facing downward. This method of stacking containers is very space efficient, meaning that more containers can be transported and stored in the same volume compared with many commonly used disposable containers, such as the well known milk carton used in schools today.

Figure 12:
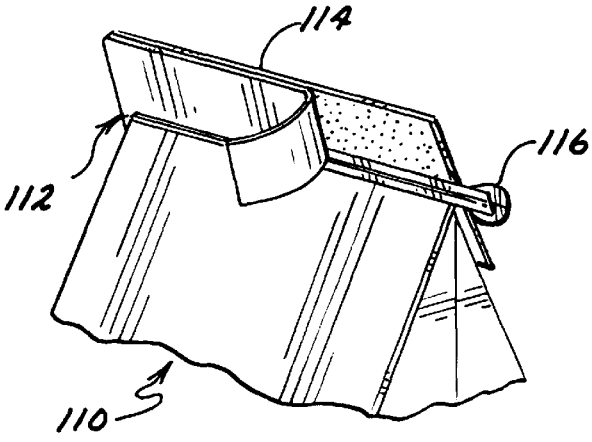
FIG. 12 shows an embodiment of the present invention that is configured to provide a filled, sealed container and illustrates one method of providing a seal therefor.
Figure 13:
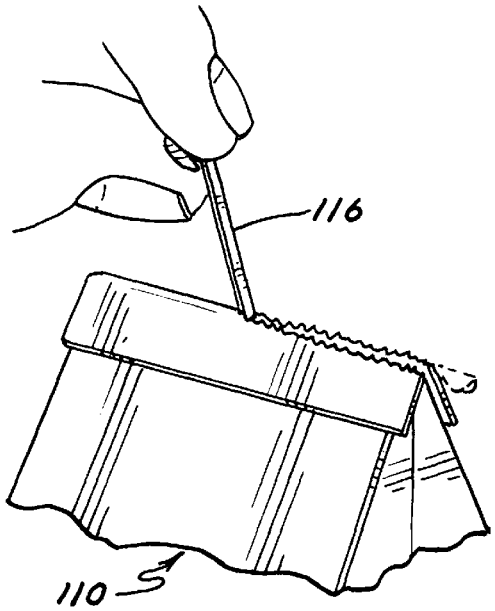
FIG. 13 illustrates the unsealing and opening of the embodiment shown in FIG. 12.

Referring now to FIG. 12, another method of providing a sealed, disposable receptacle is shown. In the embodiment 110 shown there, the receptacle 110 is filled with a fluid and then a seal is applied. As shown here, such a seal 112 may take the form of an adhesive tape 114 that is applied to the top end of the receptacle. The tape 114 will include a pull strip 116 that can be grasped by the user and pulled upon, tearing the adhesive tape 114 and opening the top of the receptacle for drinking or pouring directly from the receptacle. Other known forms of sealants or closures can be readily used with the present invention.

Figure 14:
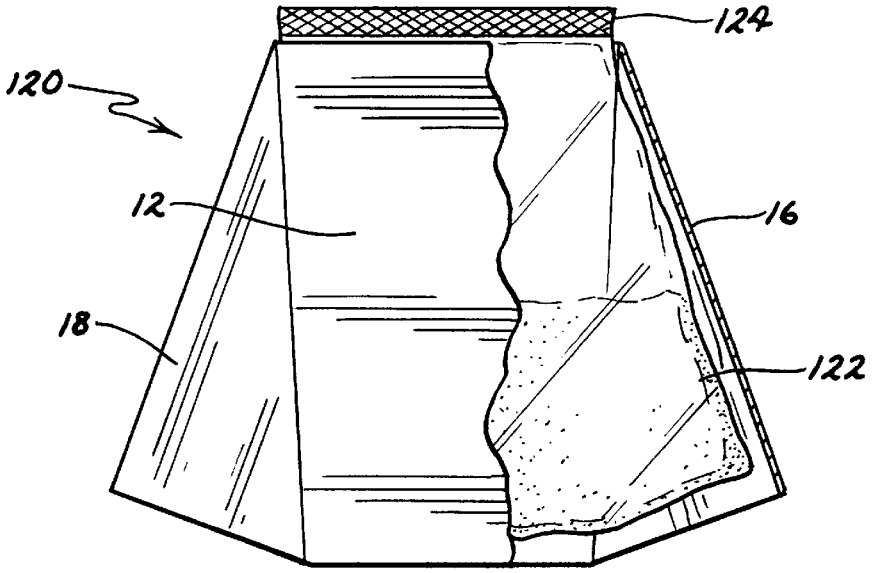
FIG. 14 shows a collapsible receptacle pre-filled with a powder with the base thereof having a six-sided polygonal configuration and with the top edges having a greater length than the base.
Figure 15:
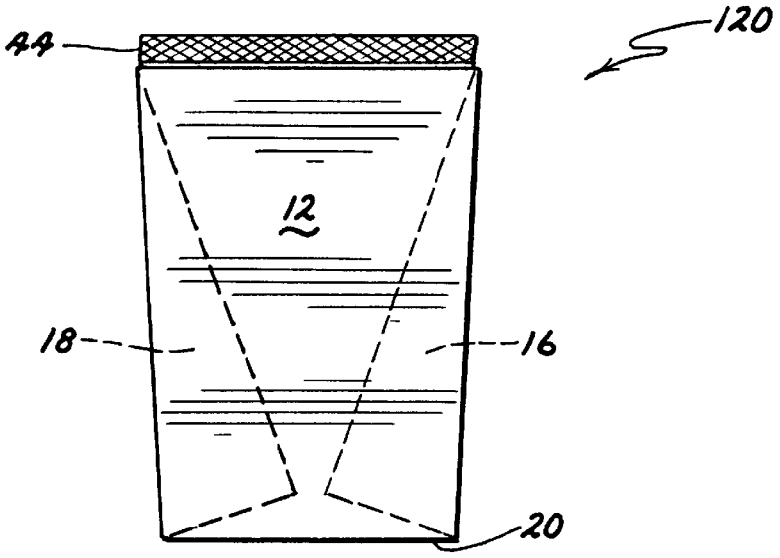
FIG. 15 illustrates the receptacle shown in FIG. 14 with the foldable sides folded inwardly.
Figure 16:
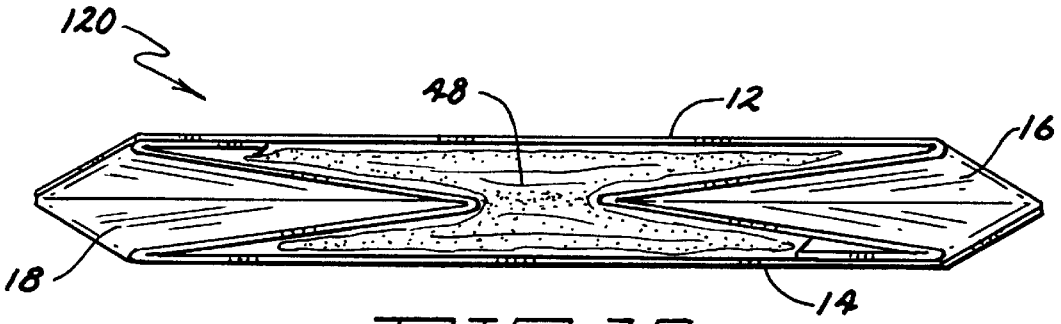
FIG. 16 depicts the receptacle shown in FIG. 15 from a bottom plan view.

Referring now to FIGS. 14–16, another embodiment 120 of the present invention will be described. As seen in FIG. 14, a receptacle 120 in accord with the present invention is shown with a liner 48 including a powder 122. This powder can be placed within the receptacle 120 during manufacture thereof and sold as is. The consumer can then unseal the receptacle, for example, by pulling on the tear strip 124, and then adding the fluid of choice, such as water or milk, to make a drink. The powder 122 could also be provided to purify water and used on camping trips, etc. The tear strip 124 could be a hermetic seal, for example, with a small portion 126 of unsealed liner extending upwardly above the top edge 44 if desired.

It will also be observed that the end walls 16, 18 are folded outwardly. In such a configuration the bottom of the receptacle 120 assumes a six-sided polygonal configuration, thus providing six separate and distinct "gripping corners" that inhibit sliding of the receptacle 120. Thus, when placed on the dash of a moving vehicle, for instance, the receptacle 120 will better "grip" the dash surface and be less susceptible to sliding during vehicle maneuvers.

Referring now to FIG. 15, it will be observed that the top edge 44 is longer than the base 20. This embodiment enables the holder of the receptacle to maintain a grip on the receptacle. With the embodiment shown in FIG. 1, the top edge is shorter than the base, which makes it more likely to slip through a holder's grip since the configuration of the receptacle narrows from the base upward. This Figure also shows in phantom how the foldable end walls 16, 18 can be folded inwardly for shipment or storage.

FIG. 16 shows a bottom view of the receptacle shown in FIG. 15 and illustrates how the sides 16 and 18 fold inwardly during shipment or storage.

In addition to the foregoing advantages, the triangular cross sectional configuration of the present invention also functions to reduce the likelihood of spillage therefrom. First, this configuration concentrates the bulk of the liquid therein at a low level, resulting in a low center of gravity and reducing the likelihood that the receptacle can be tipped over. The triangular configuration aids in this function, as does the flexible liner, which expands such that the bulk of the fluid is at the lowest possible level. Second, the square corners of the base enable the receptacle to "grip" the surface upon which it rests, thus preventing sliding of the receptacle as can typically be found a receptacle is placed upon an automobile dashboard. Third, when used in a moving vehicle the configuration aids in reducing sloshing of the fluid in the receptacle. As best seen in FIG. 6, when the a receptacle in accord with the present invention is set upon a surface, such as a dashboard, the upper portions of the liner tend to collapse inwardly, thus reducing the size of the upwardly directed "channel" through which the fluid must travel to reach the opening. This has two effects. First, only fluid that happens to slosh directly upward is likely to splash out. Second, as fluid sloshes around within the receptacle it encounters the inwardly collapsing liner walls, which in turn tend to redirect the fluid either downwardly or to the side toward the other wall. In this manner, then, the triangular configuration aids in redirecting any sloshing fluid away from the opening at the top of the receptacle. Fourth, the substantially self-closing opening helps reduce the likelihood of spillage.

The present invention can also find use where a powder is added to the container and water is added afterward for drinking. For example, the powder could be a type of drink flavoring, such as that sold under the Tang® or Kool-Aid® labels. Thus, the consumer could purchase a plurality of such receptacles with an appropriate amount of such a drink flavoring already sealed within the receptacle as in FIG. 14. The seal could be broken and water added thereto, thus providing a readily useful drink. Or, a water purification powder could be used and the receptacles could be used where the available water supply was otherwise polluted or not potable.

It will be further understood that the present invention can be made of readily recyclable materials, such as plain paper or cardboard with the synthetic liner. Many commercially available cups, particularly those used for cold drinks, are formed of a paper coated with wax, which makes recycling difficult or impossible. No such treatment is necessary with the present invention and it is useful equally well with hot or cold fluids. In addition, the present invention can be readily used with products such as motor oils. Disposal of containers for these products is a present ongoing concerning. With the present invention, the inner liner can be torn away from the outer shell, the outer shell can be disposed of with the normal recycling, and only the small, flexible inner liner may need special treatment as far as recycling of the invention goes.

The present invention having thus been described, other modifications, alterations, or substitutions may now suggest themselves to those skilled in the art, all of which are within the spirit and scope of the present invention. For example, as shown in the Figures, the top edges 44 and 46 lie substantially parallel to the base edges 20–26. They could be constructed to lie at an angle thereto; that is, one side edge of the side walls 12 and 14 will be longer than the other side edge, or in other words, the end walls 16 and 18 could have triangular configurations with differing heights. This variation will change the configuration of the side walls 12 and 14 from a rectangle to an irregular polygon, but will provide a readily apparent drinking spout. It will further be understood that while the present description has been primarily devoted to a described use as a container for holding a fluid fit for human consumption that other uses are also available, such as for holding a motor vehicle lubricant. It is therefore intended that the present invention be limited only by the scope of the attached claims below.

What is claimed is:

1. A collapsible fluid receptacle comprising:

an outer shell, said shell having an upper edge and comprising:

a pair of side walls, wherein each of said side walls has a top edge and a base and wherein said top edge is longer than said base, said side walls assuming a substantially outwardly diverging position from each other from their respective top edges to their bases when in the uncollapsed state; and a pair of end walls, wherein said end walls have a substantially triangular configuration, said end walls are foldable substantially along a line bisecting said end walls, and said bisecting lines define a height; and an inner, flexible liner attached to said shell upper edge, wherein said liner has a pair of liner side walls, said liner having a vertical length less than said height and wherein said liner side walls when holding a fluid pull slightly away from said substantially outwardly diverging shell side walls so as to create an air gap between said liner and said shell side walls.

2. The receptacle of claim 1 wherein said side walls have a substantially rectangular configuration.

3. The receptacle of claim 2 wherein said receptacle includes an opening, said opening being formed by exertion of an inwardly directed force on each end wall such that said side walls move apart from each other in the center thereof to form a substantially oval shaped opening.

4. The receptacle of claim 1 wherein said receptacle includes an opening, said opening being formed by exertion of an inwardly directed force on each end wall such that said side walls move apart from each other in the center thereof to form a substantially oval shaped opening.

5. The receptacle of claim 1 wherein said shell is formed from a single blank.

6. The receptacle of claim 1 wherein said shell is formed from a pair of substantially identical blanks.

7. The receptacle of claim 6 wherein said blanks each comprise one of said end walls and one of said side walls and a tab extending substantially the length of said one side wall, said tab being attached to said end wall of said other blank.

8. The receptacle of claim 6 wherein said receptacle includes an opening, said opening being formed by exertion of an inwardly directed force on each end wall such that said side walls move apart from each other in the center thereof to form a substantially oval shaped opening.

9. The receptacle of claim 1 wherein said liner includes a pair of liner walls lying substantially adjacent to said side walls.

* * * * *